US011136705B2

(12) United States Patent
Boylston

(10) Patent No.: US 11,136,705 B2
(45) Date of Patent: Oct. 5, 2021

(54) DETECTING MECHANICAL DECOUPLING IN A LAUNDRY APPLIANCE

(71) Applicant: Haier US Appliance Solutions, Inc., Wilmington, DE (US)

(72) Inventor: Byron Lee Boylston, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 181 days.

(21) Appl. No.: 16/412,900

(22) Filed: May 15, 2019

(65) Prior Publication Data

US 2020/0362498 A1 Nov. 19, 2020

(51) Int. Cl.

| | |
|---|---|
| ***D06F 37/30*** | (2020.01) |
| ***D06F 37/42*** | (2006.01) |
| ***D06F 33/00*** | (2020.01) |
| ***D06F 58/30*** | (2020.01) |
| *D06F 58/50* | (2020.01) |
| *D06F 103/00* | (2020.01) |
| *D06F 103/34* | (2020.01) |
| *D06F 103/44* | (2020.01) |
| *D06F 105/46* | (2020.01) |

(52) U.S. Cl.

CPC ..... *D06F 37/304* (2013.01); *D06F 33/00* (2013.01); *D06F 37/42* (2013.01); *D06F 58/30* (2020.02); *D06F 58/50* (2020.02); *D06F 2103/00* (2020.02); *D06F 2103/34* (2020.02); *D06F 2103/44* (2020.02); *D06F 2105/46* (2020.02); *D06F 2204/065* (2013.01); *D06F 2212/06* (2013.01)

(58) Field of Classification Search

CPC ..... D06F 37/304; D06F 37/42; D06F 58/30; D06F 58/50; D06F 33/00; D06F 2105/46; D06F 2103/00; D06F 2103/34; D06F 2103/44; D06F 2204/065; D06F 2212/06

USPC ..... 68/12.02

See application file for complete search history.

(56) References Cited

U.S. PATENT DOCUMENTS 5,852,881 A 12/1998 Kuroda et al.

FOREIGN PATENT DOCUMENTS

| | | | | |
|---|---|---|---|---|
| EP | 2447407 | A2 * | 5/2012 | ..... D06F 37/30 |
| JP | H10263272 | A | 10/1998 | |
| JP | 2018134262 | A | 8/2018 | |
| KR | 20180129342 | A | 12/2018 | |
| WO | WO2015008486 | A1 | 1/2015 | |

OTHER PUBLICATIONS

JPH10263272A—Machine translation (Year: 1998).*

* cited by examiner

*Primary Examiner* — Tinsae B Ayalew
(74) *Attorney, Agent, or Firm* — Dority & Manning, P.A.

(57) ABSTRACT

A method of detecting a mechanical decoupling in a laundry appliance is provided. The laundry appliance includes a rotatable basket and a motor configured to drive the rotatable basket. The method includes determining a target rotational speed and activating the motor at a first rotational speed proportional to the determined target rotational speed. The method further includes determining an actual rotational speed after activating the motor at the first rotational speed and comparing the actual rotational speed to the target rotational speed. When the actual rotational speed is greater than the target rotational speed, the method determines that the motor is decoupled from the basket.

20 Claims, 4 Drawing Sheets

DETECTING MECHANICAL DECOUPLING IN A LAUNDRY APPLIANCE

FIELD OF THE INVENTION

The present subject matter relates generally to laundry appliances having a rotatable basket and a motor to drive the rotatable basket, and more particularly to a laundry appliance operable to detect a mechanical decoupling of the motor and basket, and related methods.

BACKGROUND OF THE INVENTION

Laundry appliances, including washing machine appliances and dryer appliances, may include a cabinet with a rotatable basket rotatably mounted therein. Such appliances often employ a motor mechanically coupled to the rotatable basket, such as by a direct drive or a belt and pulley, to rotate the basket as desired.

One example of such laundry appliances is a washing machine appliance. Washing machine appliances generally includes a tub with a basket rotatably positioned within the tub. Articles to be washed, such as clothes, are placed in the machine's basket. A motor may be mechanically coupled to the basket for rotation thereof. At various points in the operation of the washing machine, the basket can rotate to move articles within the basket to facilitate washing. For example, the basket may be rotated during a rinse cycle of the washing machine appliance to facilitate distributing rinse fluid evenly on articles within the basket and/or during a spin cycle to extract liquid from the articles.

Another example of such laundry appliances is a dryer appliance. Dryer appliances generally include a cabinet with a basket mounted therein. In some dryer appliances, a motor rotates the basket during operation of the dryer appliance, e.g., to tumble articles located within a chamber defined by the basket. Dryer appliances also generally include a heater assembly that passes heated air through the chamber of the basket in order to dry moisture-laden articles disposed within the chamber. This internal air then passes from the chamber through a vent duct to an exhaust conduit, through which the air is exhausted from the dryer appliance.

However, the motor of a laundry appliance may become decoupled from the basket. For example, drive belts may eventually wear out and/or become disabled, e.g., become misaligned or break. A mechanical decoupling during operation of the laundry appliance may impair the intended functions of the laundry appliance and may further result in additional unintended detrimental circumstances. In the event of such a decoupling, it would be desirable to mitigate such unintended circumstances and/or notify a user of the mechanical decoupling.

Accordingly, a laundry appliance with features for detecting a mechanical decoupling would be useful.

BRIEF DESCRIPTION OF THE INVENTION

Aspects and advantages of the invention will be set forth in part in the following description, or may be obvious from the description, or may be learned through practice of the invention.

In one aspect of the present disclosure, a method of detecting a mechanical decoupling in a laundry appliance is provided. The laundry appliance includes a rotatable basket and a motor configured to drive the rotatable basket. The method includes determining a target rotational speed and activating the motor at a first rotational speed proportional to the determined target rotational speed. The method further includes determining an actual rotational speed after activating the motor at the first rotational speed and comparing the actual rotational speed to the target rotational speed. When the actual rotational speed is greater than the target rotational speed, the method determines that the motor is decoupled from the basket.

In another aspect of the present disclosure a laundry appliance is provided. The laundry appliance includes a rotatable basket, a motor configured to drive the rotatable basket, and a controller. The controller is configured for determining a target rotational speed and activating the motor at a first rotational speed proportional to the determined target rotational speed. The controller is further configured for determining an actual rotational speed after activating the motor at the first rotational speed and comparing the actual rotational speed to the target rotational speed. The controller is also configured for determining that the motor is decoupled from the basket when the actual rotational speed is greater than the target rotational speed.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
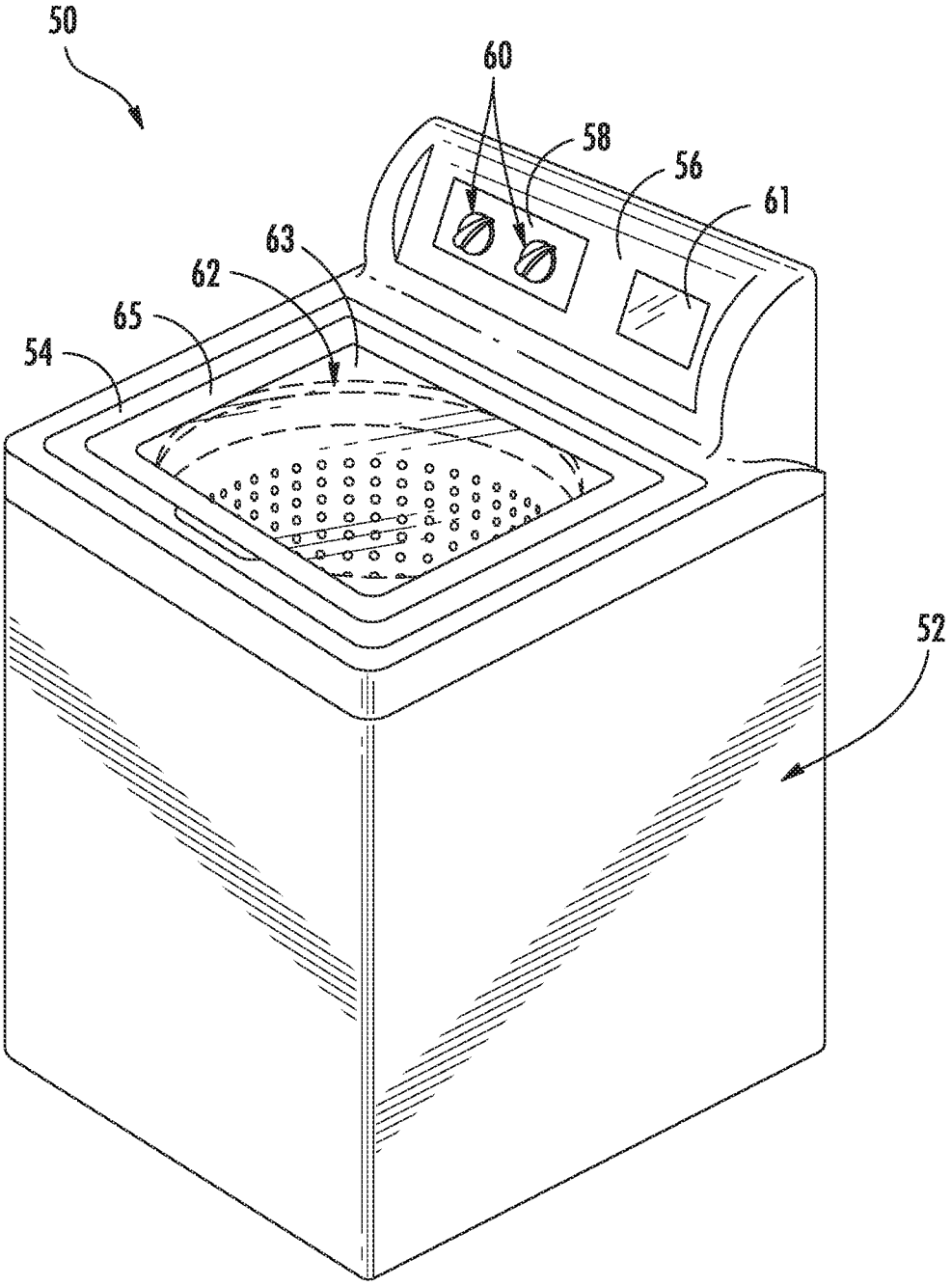
FIG. 1 provides a perspective view of a laundry appliance in accordance with one or more example embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation, such as "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

As used herein, the terms "articles," "clothing," or "laundry" include but need not be limited to fabrics, textiles, garments, linens, papers, or other items from which the extraction of moisture is desirable. Furthermore, the term "load" or "laundry load" refers to the combination of clothing that may be washed together in a washing machine or dried together in a dryer appliance (e.g., clothes dryer) and may include a mixture of different or similar articles of clothing of different or similar types and kinds of fabrics, textiles, garments and linens within a particular laundering process.

FIG. 1 is a perspective view of a washing machine appliance 50 according to an exemplary embodiment of the present subject matter. As may be seen in FIG. 1, washing machine appliance 50 includes a cabinet 52 and a cover 54. A backsplash 56 extends from cover 54, and a control panel 58, including a plurality of input selectors 60, is coupled to backsplash 56.

Control panel 58 and input selectors 60 collectively form a user interface input for operator selection of machine cycles and features, and in one embodiment, a display 61 indicates selected features, a countdown timer, and/or other items of interest to machine users. It should be appreciated, however, that in other exemplary embodiments, the control panel 58, input selectors 60, and display 61, may have any other suitable configuration. For example, in other exemplary embodiments, one or more of the input selectors 60 may be configured as manual "push-button" input selectors, or alternatively may be configured as a touchscreen on, e.g., display 61.

A lid 62 is mounted to cover 54 and is rotatable between an open position (not shown) facilitating access to a tub, also referred to as a wash tub, 64 (FIG. 2) located within cabinet 52 and a closed position (shown in FIG. 1) forming an enclosure over tub 64. Lid 62 in exemplary embodiment includes a transparent panel 63, which may be formed of, for example, glass, plastic, or any other suitable material. The transparency of the panel 63 allows users to see through the panel 63, and into the tub 64 when the lid 62 is in the closed position. In some embodiments, the panel 63 may itself generally form the lid 62. In other embodiments, the lid 62 may include the panel 63 and a frame 65 surrounding and encasing the panel 63. Alternatively, panel 63 need not be transparent.

Figure 2:
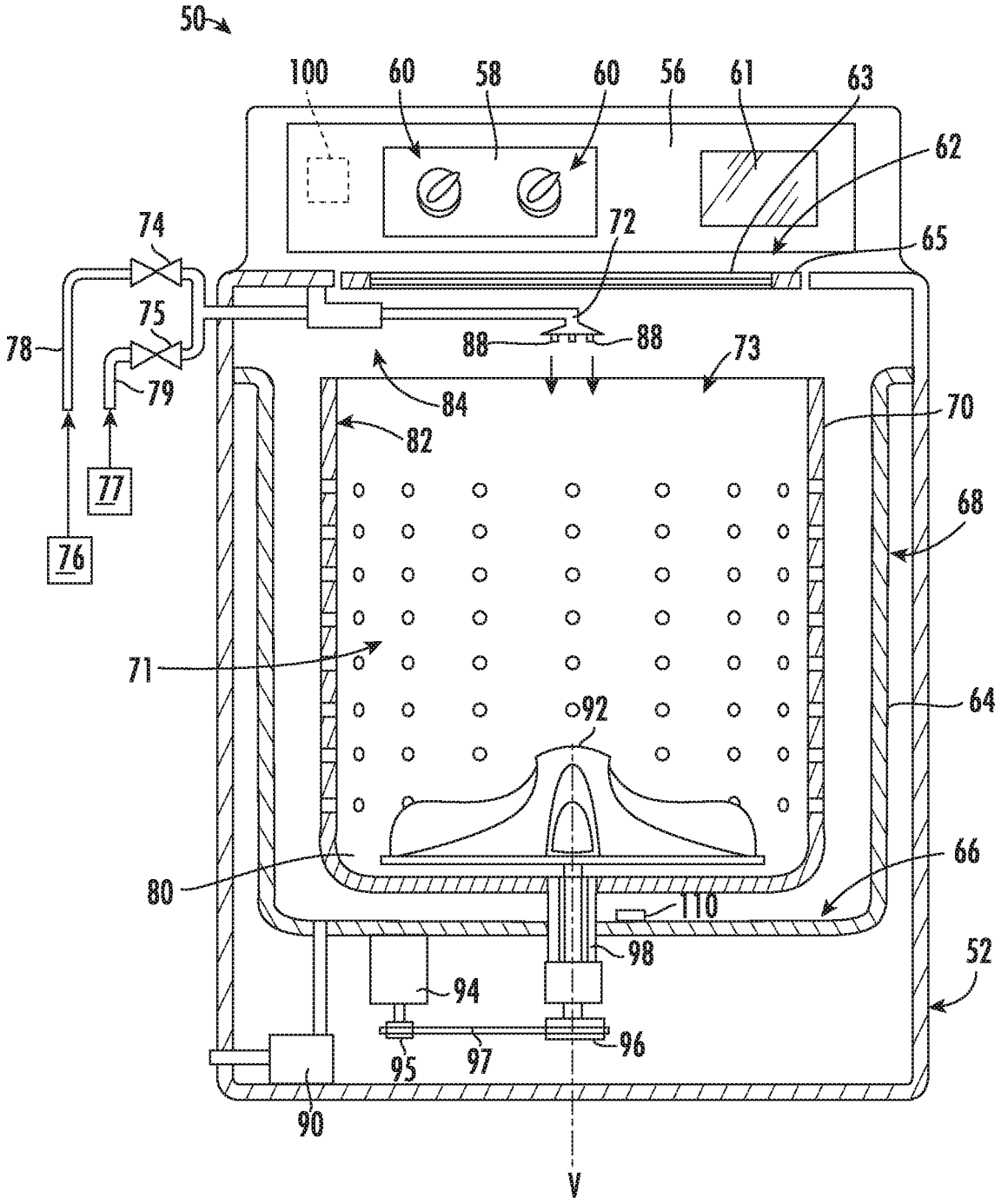
FIG. 2 provides a front, section view of the exemplary laundry appliance of FIG. 1.

FIG. 2 provides a front, cross-section view of the exemplary washing machine appliance 50 of FIG. 1. As may be seen in FIG. 2, tub 64 includes a bottom wall 66 and a sidewall 68. A wash drum or basket 70 is rotatably mounted within tub 64. In particular, basket 70 is rotatable about a vertical axis V. Thus, washing machine appliance is generally referred to as a vertical axis washing machine appliance. Basket 70 defines a wash chamber 73 for receipt of articles for washing and extends, e.g., vertically, between a bottom portion 80 and a top portion 82. Basket 70 includes a plurality of openings or perforations 71 therein to facilitate fluid communication between an interior of basket 70 and tub 64.

A nozzle 72 is configured for flowing a liquid into tub 64. In particular, nozzle 72 may be positioned at or adjacent to top portion 82 of basket 70. Nozzle 72 may be in fluid communication with one or more water sources 76, 77 in order to direct liquid (e.g. water) into tub 64 and/or onto articles within chamber 73 of basket 70. Nozzle 72 may further include apertures 88 through which water may be sprayed into the tub 64. Apertures 88 may, for example, be tubes extending from the nozzles 72 as illustrated, or simply holes defined in the nozzles 72 or any other suitable openings through which water may be sprayed. Nozzle 72 may additionally include other openings, holes, etc. (not shown) through which water may be flowed, i.e. sprayed or poured, into the tub 64.

Various valves may regulate the flow of fluid through nozzle 72. For example, a flow regulator may be provided to control a flow of hot and/or cold water into the wash chamber of washing machine appliance 50. For the embodiment depicted, the flow regulator includes a hot water valve 74 and a cold water valve 75. The hot and cold water valves 74, 75 are utilized to flow hot water and cold water, respectively, therethrough. Each valve 74, 75 can selectively adjust to a closed position in order to terminate or obstruct the flow of fluid therethrough to nozzle 72. The hot water valve 74 may be in fluid communication with a hot water source 76, which may be external to the washing machine appliance 50. The cold water valve 75 may be in fluid communication with a cold water source 77, which may be external to the washing machine appliance 50. The cold water source 77 may, for example, be a commercial water supply, while the hot water source 76 may be, for example, a water heater. Such water sources 76, 77 may supply water to the appliance 50 through the respective valves 74, 75. A hot water conduit 78 and a cold water conduit 79 may supply hot and cold water, respectively, from the sources 76, 77 through the respective valves 74, 75 and to the nozzle 72.

An additive dispenser 84 may additionally be provided for directing a wash additive, such as detergent, bleach, liquid fabric softener, etc., into the tub 64. For example, dispenser 84 may be in fluid communication with nozzle 72 such that water flowing through nozzle 72 flows through dispenser 84, mixing with wash additive at a desired time during operation to form a liquid or wash fluid, before being flowed into tub 64. For the embodiment depicted, nozzle 72 is a separate downstream component from dispenser 84. In other exemplary embodiments, however, nozzle 72 and dispenser 84 may be integral, with a portion of dispenser 84 serving as the nozzle 72, or alternatively dispenser 84 may be in fluid communication with only one of hot water valve 74 or cold water valve 75. In still other exemplary embodiments, the washing machine appliance 50 may not include a dispenser, in which case a user may add one or more wash additives directly to wash chamber 73. A pump assembly 90 (shown schematically in FIG. 2) is located beneath tub 64 and basket 70 for gravity assisted flow to drain tub 64.

In some embodiments, for example as illustrated in FIG. 2, an agitation element 92 may be provided oriented to rotate about the vertical direction V. As illustrated in FIG. 2, the basket 70 and agitation element 92 are driven by a motor 94, such as an induction motor, which is mechanically coupled to the basket 70. The motor may be mechanically coupled to the basket 70, e.g., via a drive pulley 95, a basket pulley 96, and a belt 97 as illustrated in FIG. 2. When the motor 94 is activated, the motor 94 rotates the drive pulley 95 and such rotation is transferred via the belt 97 to the basket pulley 96 which is joined to a motor output shaft 98. The basket pulley 96 may be integrally joined to the motor output shaft 98 or may be otherwise joined in any suitable manner. As motor output shaft 98 is rotated, basket 70 and agitation element 92 are operated for rotatable movement within tub 64, e.g., about vertical axis V. In other embodiments, the belt 97 may be directly connected to the basket 70, e.g., in a horizontal axis laundry appliance, such as a horizontal axis dryer appliance. In additional exemplary embodiments, the motor may be mechanically coupled to the basket without any belts or pulleys using a direct drive assembly. Various other forms of mechanical coupling may also be provided, such as via a mode shifter which selectively transfers rotation from the motor 94 to the basket 70 or the agitator 92. Such forms of mechanical coupling, e.g., a direct drive and/or mode shifter, are understood by those of skill in the art and, as such, are not illustrated in detail.

Various sensors may additionally be included in the washing machine appliance 50. For example, a pressure sensor 110 may be positioned in the tub 64 as illustrated or, alternatively, may be remotely mounted in another location within the appliance 50 and be operationally connected to tub 64 by a hose (not shown). Any suitable pressure sensor 110, such as an electronic sensor, a manometer, or another suitable gauge or sensor, may be utilized. The pressure sensor 110 may generally measure the pressure of water in the tub 64. This pressure can then be utilized to estimate the height or amount of water in the tub 64. Additionally, a suitable speed sensor can be connected to the motor 94, such as to the output shaft 98 thereof, to measure speed and indicate operation of the motor 94. Other suitable sensors, such as temperature sensors, water/moisture sensors, etc., may additionally be provided in the washing machine appliance 50.

Operation of washing machine appliance 50 is controlled by a processing device or controller 100, that is operatively coupled to the input selectors 60 located on washing machine backsplash 56 (shown in FIG. 1) for user manipulation to select washing machine cycles and features. Controller 100 may further be operatively coupled to various other components of appliance 50, such as the flow regulator (including valves 74, 75), motor 94, pressure sensor 110, speed sensor, other suitable sensors, etc. In response to user manipulation of the input selectors 60, controller 100 may operate the various components of washing machine appliance 50 to execute selected machine cycles and features.

Controller 100 is a "processing device" or "controller" and may be embodied as described herein. As used herein, "processing device" or "controller" may refer to one or more microprocessors, microcontroller, application-specific integrated circuits (ASICS), or semiconductor devices and is not restricted necessarily to a single element. The controller 100 may be programmed to operate dryer appliance 50 by executing instructions stored in memory. The controller may include, or be associated with, one or more memory elements such as for example, RAM, ROM, or electrically erasable, programmable read only memory (EEPROM). For example, the instructions may be software or any set of instructions that when executed by the processing device, cause the processing device to perform operations. Controller 100 can include one or more processor(s) and associated memory device(s) configured to perform a variety of computer-implemented functions and/or instructions (e.g. performing the methods, steps, calculations and the like and storing relevant data as disclosed herein). It should be noted that controllers 100 as disclosed herein are capable of and may be operable to perform any methods and associated method steps as disclosed herein.

While described in the context of specific embodiments of washing machine appliance 50, using the teachings disclosed herein it will be understood that washing machine appliance 50 is provided by way of example only. Other laundry appliances having different configurations (such as horizontal-axis washing machine appliances, or various clothes dryer appliances), different appearances, and/or different features may also be utilized with the present subject matter as well. For example, the basic structure and function of a dryer appliance are understood by those of ordinary skill in the art and, as such, are not specifically illustrated or described herein for the sake of brevity and clarity.

Figure 3:
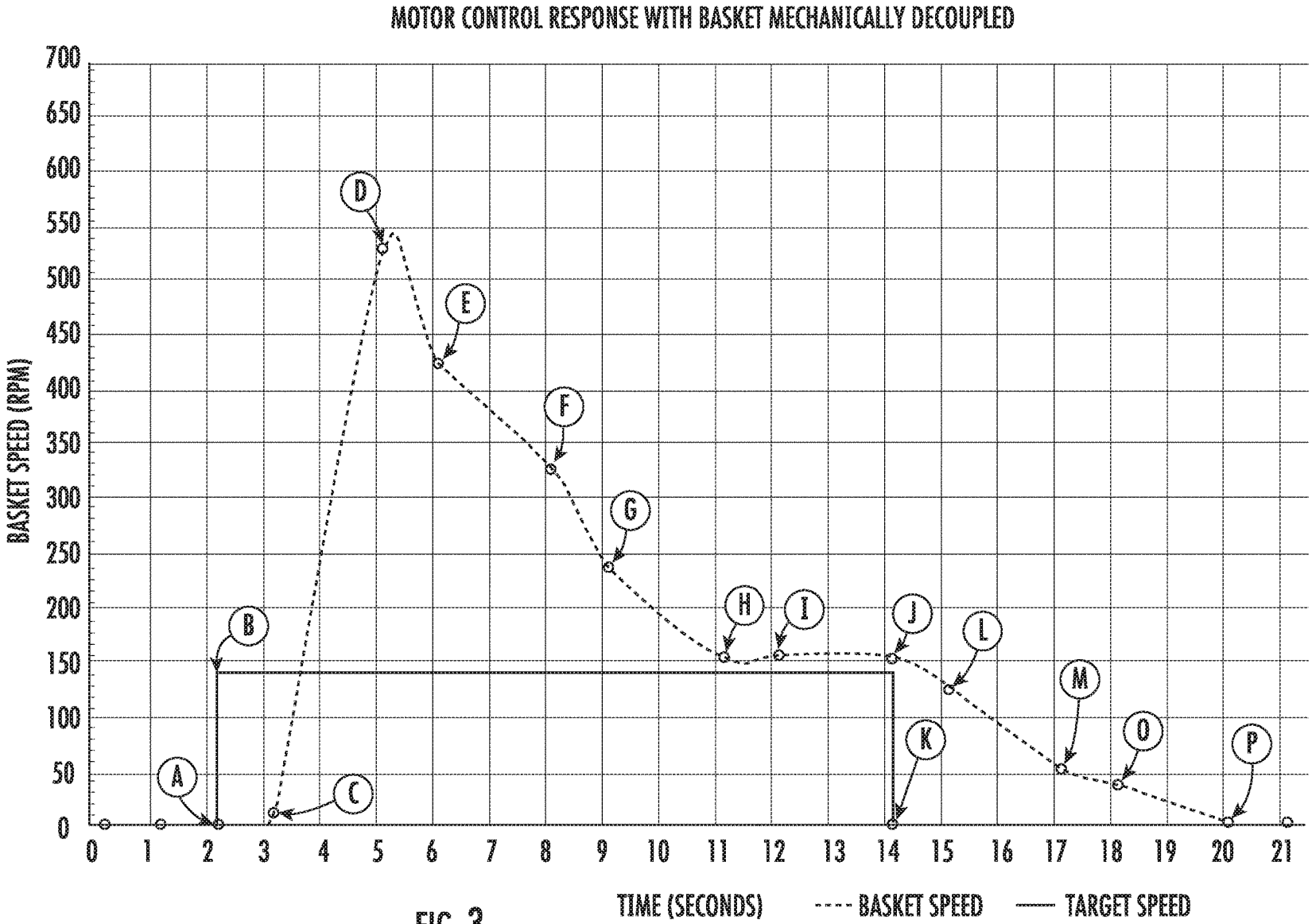
FIG. 3 provides a graph of exemplary motor control operation when the motor is mechanically decoupled.

FIG. 3 illustrates an exemplary motor control response which may be indicative of a mechanical decoupling of the basket 70 and motor 94. Such mechanical decoupling may result from a disablement of the belt 97, such as a break in the belt 97 or a misalignment of belt 97 with the drive pulley 95, another portion of the motor 94, or basket pulley 96. Additional example sources of mechanical decoupling include, but are not limited to, failure of the motor output shaft 98, transmission failure, or mode shifter failure. In the example illustrated by FIG. 3, a target speed may initially by zero, e.g., at point A, and the laundry appliance 50, e.g., motor 94 thereof in particular, may be inactive. At point B, the target speed may be received or input, e.g., to the controller 100 by user inputs 60, or otherwise determined, such as based on a predetermined time having elapsed within a laundry cycle, such as after a rinse cycle. Thus, it should be understood that the line "Target Speed" in FIG. 3 indicates example values of a control input or setting which may be received or otherwise determined by the controller 100. In response to the Target Speed, a control signal may be provided or transmitted to the motor 94 from the controller 100. For example, the controller 100 may regulate the electrical input power applied to the motor 94, as will be understood by those of ordinary skill in the art, to achieve or approximate the desired target speed in response to a setting received from the user interface. Note that the signal from the controller 100 to the motor 94 is not depicted in FIG. 3.

When the control signal to the motor 94 increases at point B, e.g., to 140 RPM as illustrated in FIG. 3, the motor 94 is thereby activated and begins to rotate. Thus, the target speed may be understood as a rotational speed. In some embodiments, the target rotational speed may be a speed of the motor 94, the drive pulley 95, or the basket pulley 96, or combinations thereof. In other embodiments, for example as illustrated in FIG. 3, the target speed may be a basket speed and the target rotational speed of the basket 70 may be compared to an actual rotational speed of the basket 70. In various embodiments, the actual speed, e.g., the actual rotational speed of the basket 70, may be directly measured or may be calculated. For example, the actual rotational speed of the basket 70 may be directly measured with an accelerometer or rotation counter, e.g., a Hall effect sensor, on the basket 70 itself. As another example, the actual rotational speed of the basket 70 may be calculated based on a directly measured drive speed of the pulley 95 or 96 times a drive ratio. Various combinations of the foregoing are possible. For example, the target speed may be a speed of the basket pulley 96 and the actual speed of the basket pullet 96 may be a directly measured or calculated speed of the basket pulley 96. For example, the actual speed of the basket pulley 96 may be calculated based on a directly measured drive pulley 95 speed and a ratio of the drive pulley 95 and the basket pulley 96.

As shown at points C and D, the initial rotation of the motor 94 may result in a sudden and sharp increase in the actual speed. For example, when the actual speed is based on a measured speed of the motor 94 or a pulley 95/96, the actual speed in the event of a mechanical decoupling may be much greater than expected due to the absence of the inertial load of the basket 70. When the actual speed exceeds the target speed, e.g., as shown at point D in FIG. 3, the speed of the motor 94 may be reduced in order to bring the actual speed to or closer to the target speed. For example, as may be seen in FIG. 3 from point D to point E, from point E to point F, from point F to point G, and from point G to point H, the laundry appliance 50, such as the controller 100 thereof, may go through a series of adjustments to try to bring the actual speed in line with the target speed. For example, such series of adjustments or steps may be iterations of a closed loop control system, such as a proportional-integral (PI) control loop or a proportional-integral-derivative (PID) control loop.

At points H, I, and J, the control loop continues to attempt to reach the set point (target speed) of 140 RPM. When the actual speed starts out greater than the target speed, e.g., at point D, and then decreases to approach the target speed, e.g., from points D through H, a subsequent step or iteration of the control loop after the actual speed approaches the target speed, such as from point H to point I and/or from point I to point J, may, e.g., in the event of reduced load on the motor 70 due to mechanical decoupling with the basket 70, result in the actual speed continuing to exceed the target speed and, in some instances, such as is illustrated in FIG. 3 from H to J, deviating farther from the target speed. When the actual speed continues to exceed the target speed, the motor 94 may then be deactivated, e.g., at point K in FIG. 3, the target speed may be set to zero (0 RPM). Following such deactivation, the motor 94 may then decelerate, e.g., as shown at points J, L, M, O, and P in FIG. 3. In the example illustrated by FIG. 3, the actual speed decreases to zero in about six seconds after the motor 94 is deactivated at point K.

Figure 4:
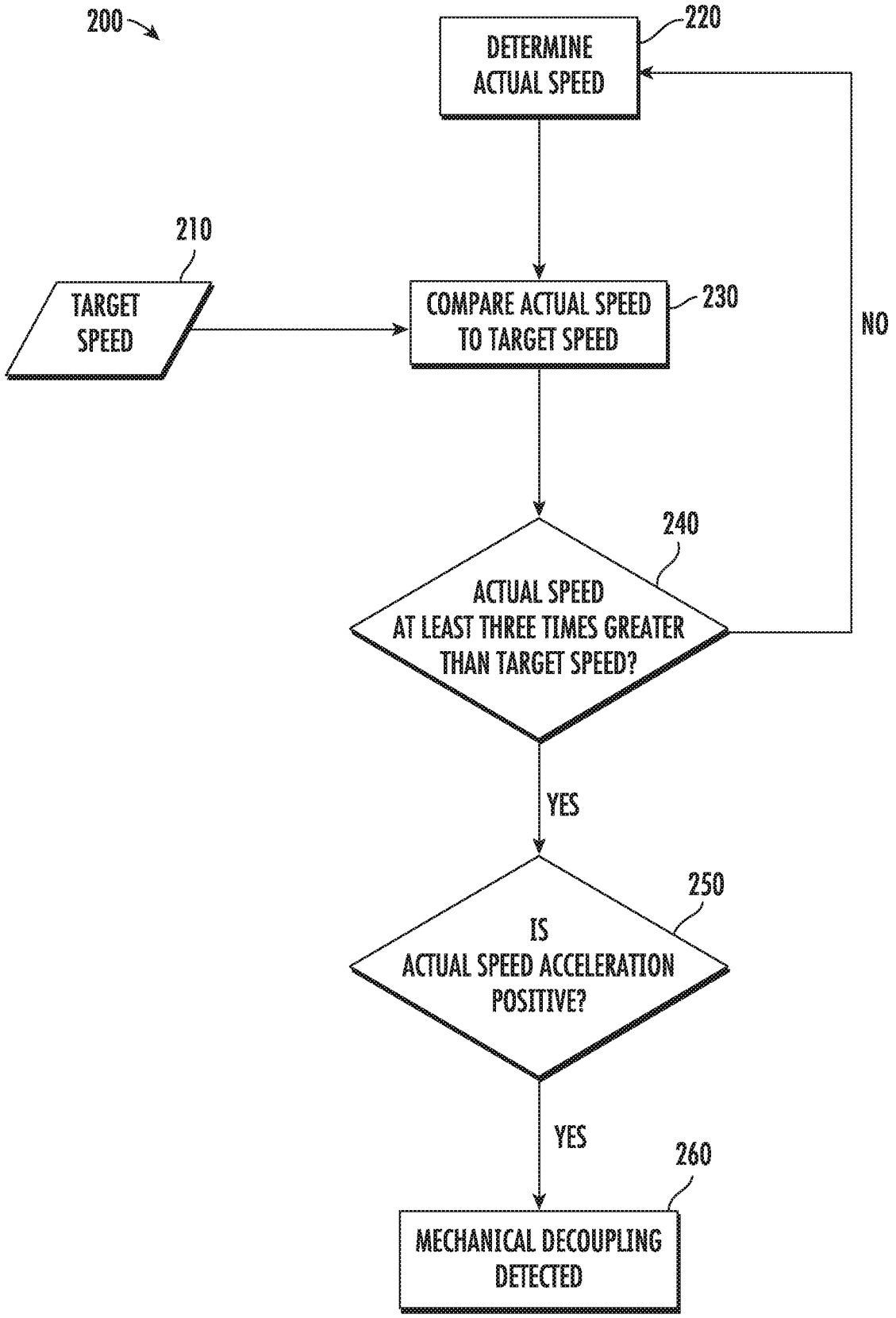
FIG. 4 is a flow chart illustrating a method of mechanical decoupling in a laundry appliance in accordance with one or more example embodiments of the present disclosure.

Embodiments of the present disclosure include methods of operating a laundry appliance and/or detecting a mechanical decoupling in a laundry appliance. One example of such embodiments is the method 200 illustrated in FIG. 4. As shown in FIG. 4, the method 200 may include a step 210 of determining a target speed and a step 220 of determining an actual speed. As mentioned above, the speeds may be rotational speeds. Also as mentioned above, the target speed may be determined based on a user input or as part of a predetermined operational cycle and the actual speed may be directly measured or calculated. The exemplary method 200 may further include a step 230 of comparing the actual speed to the target speed and a step 240 of determining whether the actual speed is greater than the target speed, such as at least three times greater than the target speed. When the determination at step 240 is NO, e.g., when the actual speed is less than or equal to the target speed, and/or is less than three times greater than the target speed, the method 200 may return to step 220 and again measure or calculate the actual speed. In some embodiments, the method 200 may include monitoring or continuously/repeatedly determining the actual speed.

When the determination at step 240 is YES, e.g., when the actual speed is greater than the target speed, such as at least three times greater than the target speed, the method 200 may proceed to a step 250 of determining whether the actual speed is increasing, e.g., whether the actual speed acceleration is positive. As noted above, this response may indicate a mechanical decoupling has occurred. Accordingly, when the actual acceleration is positive and the actual speed is greater than the target speed, such as at least three times greater than the target speed, the method 200 may then determine that the motor 94 is decoupled from the basket 70, e.g., may include a step 260 of detecting a mechanical decoupling. For example, the method 200 may determine that a mechanical decoupling has been detected based on the motor response as shown at point D in FIG. 3, where the actual speed is at least three times greater than the target speed, and/or based on the motor response shown from point H to point I in FIG. 3, where the actual speed is greater than the target speed, has remained above the target speed for a period of time, and the acceleration is positive.

In some embodiments, a method of detecting a mechanical decoupling in a laundry appliance may include and/or a controller of a laundry appliance may be configured for determining a target rotational speed, e.g., based on a user input, and activating the motor at a first rotational speed proportional to the determined target rotational speed. For example, the first rotational speed may be a speed of the motor and the determined target rotational speed may be a basket rotational speed. In such embodiments, the first rotational speed of the motor may be proportional to the determined target speed of the basket based on a drive ratio of the laundry appliance.

In some embodiments, the method may further include and/or the controller may further be configured for determining an actual rotational speed after activating the motor at the first rotational speed. The actual rotational speed may be a speed of the same component in the laundry appliance as the target rotational speed. For example, when the target rotational speed is a basket rotational speed, the determined actual rotational speed will also be a speed of the basket, and may be determined through direct measurement or may be calculated.

In some embodiments, the method may further include and/or the controller may further be configured for comparing the actual rotational speed to the target rotational speed and determining that the motor is decoupled from the basket when the actual rotational speed is greater than the target rotational speed. It may be determined that the motor is mechanically decoupled from the basket because the actual rotational speed is greater than the target speed where, as noted above, such conditions may be indicative of a mechanical decoupling. For example, determining that the motor is decoupled from the basket when and because the actual rotational speed is greater than the target rotational speed may include determining that the motor is decoupled from the basket when and because the actual rotational speed is at least three times greater than the target rotational speed, e.g., as illustrated at point D in FIG. 3. In some exemplary embodiments, determining that the motor is decoupled from the basket may include determining that the motor is decoupled from the basket when and because the actual rotational speed is greater than about two times the target rotational speed and less than about ten times the target rotational speed, such as greater than about two and a half times the target rotational speed and less than about eight times the target rotational speed, such as between about three times and about five times greater than the target rotational speed.

In some embodiments, the actual rotational speed nay be a first actual rotational speed. In such embodiments, the method may further include and/or the controller may be further configured for activating the motor at a second rotational speed less than the first rotational speed after comparing the first actual rotational speed to the target rotation speed when the first actual rotational speed is greater than the target rotational speed. For example, in such embodiments comparing the actual rotational speed to the target rotational speed may include inputting the actual rotational speed and the target rotational speed into a closed control loop, and the second rotational speed less than the first rotational speed may be based on an output of the closed control loop. The closed control loop may be, for example, a PID control loop as described above.

In embodiments which include activating the motor at the second rotational speed less than the first rotational speed, e.g., at point E relative to point D in FIG. 3, and/or at point F relative to point E, etc., a second actual rotational speed may be determined after activating the motor at the second rotational speed. For example, the second actual rotational speed may be determined following a predetermined time lapse after comparing the first actual rotational speed to the target rotational speed when the first actual rotational speed is greater than the target rotational speed. The predetermined time lapse may be between about one half second (0.5 s) and about four seconds (4 s), such as between about one second (1 s) and about three seconds (3 s). In some embodiments, e.g., as illustrated in FIG. 3, the predetermined time lapse may be about one to two seconds. The determined second actual rotational speed may then be compared to the target rotational speed. Such embodiments may further include determining that the motor is decoupled from the basket when and because the first actual rotational speed and the second actual rotational speed are both greater than the target rotational speed.

In various embodiments, the method may further include and/or the controller may further be configured for adjusting the operation of the laundry appliance after detecting the mechanical decoupling. For example, some embodiments may include deactivating the motor after determining that the motor is decoupled from the basket. As another example, some embodiments may also or instead include providing a user notification after determining that the motor is decoupled from the basket. In various embodiments, providing the notification to the user may include providing a graphic or written notification and/or an audible notification. Such notifications, whether written, audible, or both, may be delivered via the laundry appliance 50, e.g., the user interface thereof such as the display 61, and/or a remote user interface on a remote user interface device such as a smartphone or tablet. Various combinations, up to and including both a written and an audible notification on both the washing machine appliance user interface and the remote user interface device are possible. In various exemplary embodiments, the notification may be a written notification, e.g., one or more text messages. Such written notifications may include, e.g., a text message delivered via email or SMS to a cellphone, tablet computer, smartphone, smart watch, desktop computer, or any other suitable communication device. The text message(s) may also be delivered via the interne, a home network, e.g., intranet, or any other suitable network. Further, such written notifications may be delivered via a dedicated computer program such as a smartphone application or "app." Additionally, written notifications may also include displaying the text message(s) on the display 61 of the laundry appliance 50, as well as or instead of on a remote device. It is understood that any combination of such messages may be provided, e.g., some or all of an email, an SMS message, and the display 61 on the appliance 50 in various combinations may be provided.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of detecting a mechanical decoupling in a laundry appliance, the laundry appliance comprising a rotatable basket, a motor configured to drive the rotatable basket, a pulley, and a drive belt for transferring rotation from the motor to the basket, the method comprising:

determining a target rotational speed of the basket;

activating the motor at a first rotational speed proportional to the determined target rotational speed of the basket;

determining an actual rotational speed of the basket after activating the motor at the first rotational speed by measuring a rotational speed of the pulley and calculating the actual rotational speed of the basket based on the measured rotational speed of the pulley;

comparing the actual rotational speed of the basket to the target rotational speed of the basket; and determining that the motor is decoupled from the basket when the actual rotational speed of the basket is greater than the target rotational speed of the basket.

2. The method of claim 1, wherein determining that the motor is decoupled from the basket comprises determining that the motor is decoupled from the basket when the actual rotational speed of the basket is at least three times greater than the target rotational speed of the basket.

3. The method of claim 1, wherein determining that the motor is decoupled from the basket comprises determining that the motor is decoupled from the basket when the actual rotational speed of the basket is between three and five times greater than the target rotational speed of the basket.

4. The method of claim 1, wherein the actual rotational speed of the basket is a first actual rotational speed of the basket, further comprising:

activating the motor at a second rotational speed less than the first rotational speed after comparing the first actual rotational speed of the basket to the target rotational speed of the basket when the first actual rotational speed of the basket is greater than the target rotational speed of the basket;

determining a second actual rotational speed of the basket after activating the motor at the second rotational speed; and comparing the second actual rotational speed of the basket to the target rotational speed of the basket;

wherein determining that the motor is decoupled from the basket comprises determining that the motor is decoupled from the basket when the first actual rotational speed of the basket and the second actual rotational speed of the basket are both greater than the target rotational speed of the basket.

5. The method of claim 1, wherein the actual rotational speed of the basket is a first actual rotational speed of the basket, further comprising:

determining a second actual rotational speed of the basket following a predetermined time lapse after comparing the first actual rotational speed of the basket to the target rotational speed of the basket when the first actual rotational speed of the basket is greater than the target rotational speed of the basket; and comparing the second actual rotational speed of the basket to the target rotational speed of the basket;

wherein determining that the motor is decoupled from the basket comprises determining that the motor is decoupled from the basket when the first actual rotational speed of the basket and the second actual rotational speed of the basket are both greater than the target rotational speed.

6. The method of claim 1, further comprising deactivating the motor after determining that the motor is decoupled from the basket.

7. The method of claim 1, further comprising providing a user notification after determining that the motor is decoupled from the basket.

8. The method of claim 1, wherein comparing the actual rotational speed of the basket to the target rotational speed of the basket comprises inputting the actual rotational speed of the basket and the target rotational speed of the basket into a closed control loop, further comprising activating the motor at a second rotational speed less than the first rotational speed after comparing the first actual rotational speed of the basket to the target rotational speed based of the basket on an output of the closed control loop.

9. The method of claim 8, wherein the closed control loop is a PID control loop.

10. The method of claim 1, wherein the laundry appliance is a washing machine appliance.

11. The method of claim 1, wherein the laundry appliance is a dryer appliance.

12. A laundry appliance, comprising:

a rotatable basket;

a motor configured to drive the rotatable basket; and a controller, the controller configured for:

determining a target rotational speed;

activating the motor at a first rotational speed proportional to the determined target rotational speed;

determining a first actual rotational speed after activating the motor at the first rotational speed;

comparing the actual rotational speed to the target rotational speed;

activating the motor at a second rotational speed less than the first rotational speed after comparing the first actual rotational speed to the target rotation speed when the first actual rotational speed is greater than the target rotational speed;

determining a second actual rotational speed after activating the motor at the second rotational speed;

comparing the second actual rotational speed to the target rotational speed; and determining that the motor is decoupled from the basket when the first actual rotational speed and the second actual rotational speed are both greater than the target rotational speed.

13. The laundry appliance of claim 12, wherein the controller is configured for determining that the motor is decoupled from the basket when the actual rotational speed is at least three times greater than the target rotational speed.

14. The laundry appliance of claim 12, wherein the controller is configured for determining that the motor is decoupled from the basket when the actual rotational speed is between three and five times greater than the target rotational speed.

15. The laundry appliance of claim 12, wherein the controller is further configured for deactivating the motor after determining that the motor is decoupled from the basket.

16. The laundry appliance of claim 12, wherein the controller is further configured for providing a user notification after determining that the motor is decoupled from the basket.

17. A method of detecting a mechanical decoupling in a laundry appliance, the laundry appliance comprising a rotatable basket, a motor configured to drive the rotatable basket, and a direct drive assembly for transferring rotation from the motor to the basket, the method comprising:

determining a target rotational speed of the basket;

activating the motor at a first rotational speed proportional to the determined target rotational speed of the basket;

determining an actual rotational speed of the basket after activating the motor at the first rotational speed by measuring a rotational speed of the motor and calculating the actual rotational speed of the basket based on the measured rotational speed of the motor and a drive ratio of the direct drive assembly;

comparing the actual rotational speed of the basket to the target rotational speed of the basket; and determining that the motor is decoupled from the basket when the actual rotational speed of the basket is greater than the target rotational speed of the basket.

18. The method of claim 17, wherein the actual rotational speed of the basket is a first actual rotational speed of the basket, further comprising:

activating the motor at a second rotational speed less than the first rotational speed after comparing the first actual rotational speed of the basket to the target rotational speed of the basket when the first actual rotational speed of the basket is greater than the target rotational speed of the basket;

determining a second actual rotational speed of the basket after activating the motor at the second rotational speed; and comparing the second actual rotational speed of the basket to the target rotational speed of the basket;

wherein determining that the motor is decoupled from the basket comprises determining that the motor is decoupled from the basket when the first actual rotational speed of the basket and the second actual rotational speed of the basket are both greater than the target rotational speed of the basket.

19. The method of claim 17, wherein the actual rotational speed of the basket is a first actual rotational speed of the basket, further comprising:

determining a second actual rotational speed of the basket following a predetermined time lapse after comparing the first actual rotational speed of the basket to the target rotational speed of the basket when the first actual rotational speed of the basket is greater than the target rotational speed of the basket; and comparing the second actual rotational speed of the basket to the target rotational speed of the basket;

wherein determining that the motor is decoupled from the basket comprises determining that the motor is decoupled from the basket when the first actual rotational speed of the basket and the second actual rotational speed of the basket are both greater than the target rotational speed.

20. The method of claim 17, wherein comparing the actual rotational speed of the basket to the target rotational speed of the basket comprises inputting the actual rotational speed of the basket and the target rotational speed of the basket into a closed control loop, further comprising activating the motor at a second rotational speed less than the first rotational speed after comparing the first actual rotational speed of the basket to the target rotational speed based of the basket on an output of the closed control loop.

* * * * *